US009208922B2

(12) United States Patent
Yoshida et al.

(10) Patent No.: US 9,208,922 B2
(45) Date of Patent: Dec. 8, 2015

(54) SHIELD CONNECTOR

(71) Applicant: Sumitomo Wiring Systems, Ltd., Yokkaichi, Mie (JP)

(72) Inventors: Keiichi Yoshida, Yokkaichi (JP); Hiroyuki Matsuoka, Yokkaichi (JP); Takuya Tate, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/525,263

(22) Filed: Oct. 28, 2014

(65) Prior Publication Data

US 2015/0129305 A1 May 14, 2015

(30) Foreign Application Priority Data

Nov. 12, 2013 (JP) ..... 2013-233908

(51) Int. Cl.

| | |
|---|---|
| ***H01B 7/00*** | (2006.01) |
| ***H01B 3/30*** | (2006.01) |
| ***H01B 1/02*** | (2006.01) |
| ***H01R 13/6596*** | (2011.01) |
| *H01R 13/6593* | (2011.01) |

(52) U.S. Cl.

CPC .. *H01B 3/30* (2013.01); *H01B 1/02* (2013.01); *H01R 13/6596* (2013.01); *H01R 13/6593* (2013.01)

(58) Field of Classification Search

CPC ..... H01R 13/6593; H01R 13/6592; H01R 13/6591; H01B 7/0045; H01B 1/02; H01B 3/30

USPC ..... 174/74 R; 439/607.55, 607.41, 607.44, 439/607.28, 607.57, 607.56

See application file for complete search history.

(56) References Cited

U.S. PATENT DOCUMENTS

| | | | | |
|---|---|---|---|---|
| 6,837,728 | B2 * | 1/2005 | Miyazaki et al. | 439/271 |
| 7,229,316 | B2 * | 6/2007 | Takaku et al. | 439/607.56 |
| 7,666,032 | B2 * | 2/2010 | Aoki et al. | 439/607.41 |
| 2004/0106325 | A1 * | 6/2004 | Miyazaki | 439/607 |
| 2005/0266729 | A1 * | 12/2005 | Fukushima et al. | 439/610 |
| 2007/0141907 | A1 * | 6/2007 | Kuo et al. | 439/607 |
| 2008/0214044 | A1 * | 9/2008 | Ko et al. | 439/499 |
| 2010/0136832 | A1 * | 6/2010 | Kawaguchi et al. | 439/607.03 |
| 2010/0184333 | A1 * | 7/2010 | Wang et al. | 439/626 |

(Continued)

FOREIGN PATENT DOCUMENTS

| | | |
|---|---|---|
| JP | 2010-225370 | 10/2010 |

*Primary Examiner* — Hoa C Nguyen
*Assistant Examiner* — Amol Patel
(74) *Attorney, Agent, or Firm* — Gerald E. Hespos; Michael J. Porco; Matthew T. Hespos

(57) ABSTRACT

A first shield connector (20) includes a first housing 21 made of resin, wires (40), a shield member (50) to be mounted on the wires (40), and two brackets (61, 62) including a plate-like first shield member connecting portion (64) to be crimped to a peripheral edge of the shield member (50) and case connecting portions (65) to be connected to a case of a motor. The case connecting portions (65) are arranged at sides of the shield member connecting portions (64) arranged to face each other and bolt-fastened to the case in an overlapping state. The case connecting portions (65) are formed with a stopper (66) including a hole (66A). The first housing (21) is formed with retaining projections (23) to be inserted through the holes (66A). The brackets (61, 62) are held on the first housing (21) by inserting the retaining projections (23) through the holes (66A).

5 Claims, 11 Drawing Sheets

(56) References Cited

U.S. PATENT DOCUMENTS

2012/0122341 A1* 5/2012 Okamoto ..... 439/607.55
2012/0312597 A1* 12/2012 Toyama et al. ..... 174/84
2013/0065405 A1* 3/2013 Tsuchiya et al. ..... 439/34
2013/0189879 A1* 7/2013 Kondo ..... 439/607.44
2014/0051282 A1* 2/2014 Tanaka et al. ..... 439/502
2014/0073185 A1* 3/2014 Siahaan et al. ..... 439/607.58
2014/0305696 A1* 10/2014 Tanaka et al. ..... 174/71 R
2014/0308847 A1* 10/2014 Tanaka et al. ..... 439/607.41
2014/0329410 A1* 11/2014 Tanaka et al. ..... 439/607.41

* cited by examiner

SHIELD CONNECTOR

BACKGROUND

1. Field of the Invention

The invention relates to a shield connector with brackets.

2. Description of the Related Art

Japanese Unexamined Patent Publication No. 2010-225370 discloses a shield connector with brackets. This shield connector is fittable into a mounting hole on a case of a device. Further, the shield connector includes a housing made of synthetic resin and a shield shell made of metal and configured to cover the housing. The housing is formed with locks for retaining the shield shell. The locks are in the form of cantilevers and extend back in a connecting direction along the outer peripheral surface of the housing. Locking projections formed on extending ends of the locks and are displaceable in a direction intersecting the outer peripheral surface of the housing.

The shield shell is formed with a tubular portion onto which a tubular shield member (e.g. braided wire) for collectively covering a plurality of wires is to be mounted. By covering the outer periphery of this tubular portion with the shield member and caulking a caulking ring on an outer peripheral side of the shield member, the shield member is pressed against the tubular portion. The locks are locked to a rear end opening edge of the tubular portion from behind to hold the shield shell on the housing. Further, the tubular portion is formed integrally by drawing a metal plate as a base material. Thus, the wires drawn out backward from the housing need to be passed through the tubular portion in advance before a caulking operation is performed.

A sheet-like shield member may be used instead of the tubular shield member and may be wound around the wires from behind. In this situation, it is considered to prepare a bracket including a plate-like crimping piece instead of using a tubular crimping member such as the tubular portion and the caulking ring and mount the bracket on the housing after the crimping piece is crimped to a peripheral edge part of the shield member. However, the conventional lock portions cannot be used as they are in this method, and a new assembling method is necessary.

The invention was completed based on the above situation and aims to enable a bracket including a plate-like crimping piece to be mounted on a housing.

SUMMARY OF THE INVENTION

The invention is directed to a shield connector to be mounted on a case of a device. The shield connector includes a housing made of resin and a wire is drawn out from the housing. A shield member made of electrically conductive metal is mounted on the wire to shield the wire, and two brackets including plate-like shield member connecting portions are crimped to a peripheral edge part of the shield member. A case connecting portion is connected to the case of the device. Two of the case connecting portions are arranged at sides of the shield member connecting portions arranged to face each other and bolt-fastened to the case in an overlapping state. The case connecting portion is formed with a stopper including a hole. The housing is formed with retaining projections to be inserted through the holes, and the brackets are held on the housing by inserting the retaining projections through the holes.

According to this configuration, the two shield member connecting portions are arranged to face each other and the pair of case connecting portions are arranged in the overlapping state, and the pair of case connecting portions in the overlapping state are bolt-fastened to the case, thereby fixing the brackets to the case. The brackets can be held on the housing by inserting the retaining projections of the housing through the holes of the stopper portions of the brackets. In this way, the brackets including a plate-like crimping piece can be mounted on the housing.

A holding projection may be formed on either one of the case connecting portions and the pair of case connecting portions may be held in the overlapping state by hooking the holding projection to a peripheral edge part of the other case connecting portion. According to this configuration, the case connecting portions can be held in the overlapping state by hooking the holding projection formed on the one case connecting portion to the peripheral edge part of the other case connecting portion after the brackets are brought closer to each other and the case connecting portions are overlapped.

The stopper portions may be formed to bulge out toward the housing from peripheral edges of the case connecting portions. Thus, the holding projections of the housing can be reduced in size since the stopper portions can be arranged close to the housing.

One shield member connecting portion may be formed with a mounting projection projecting toward the other shield member connecting portion and the housing may be formed with a mounting hole into which the mounting projection is to be inserted. Thus, the brackets can be mounted more stably on the housing by inserting the mounting projection into the mounting hole besides by the stopper portions.

The mounting projection may be formed on each of the shield member connecting portions and the mounting holes into which the mounting projections are to be inserted may communicate with each other. Thus, the brackets can be mounted more stably on the housing by inserting the mounting projections into the mounting holes.

According to the invention, it is possible to enable a bracket including a plate-like crimping piece to be mounted on a housing.

DETAILED DESCRIPTION

A wiring harness 10 according to an embodiment of the invention is illustrated in FIGS. 1 to 11 and is a power cable for connecting a motor (not shown) and an inverter (not shown). The inverter is not coupled directly to the motor and an inverter-side terminal block (not shown) mounted on a case of the inverter and a motor-side terminal block (not shown) mounted on a case of the motor are arranged very close to each other. A first shield connector 20 is provided on one end of the wiring harness 10 and a second shield connector 30 is provided on the other end of the wiring harness 10. The first shield connector 20 is fit and connected to the motor-side terminal block and the second shield connector 30 is fit and connected to the inverter-side terminal block.

Figure 3:
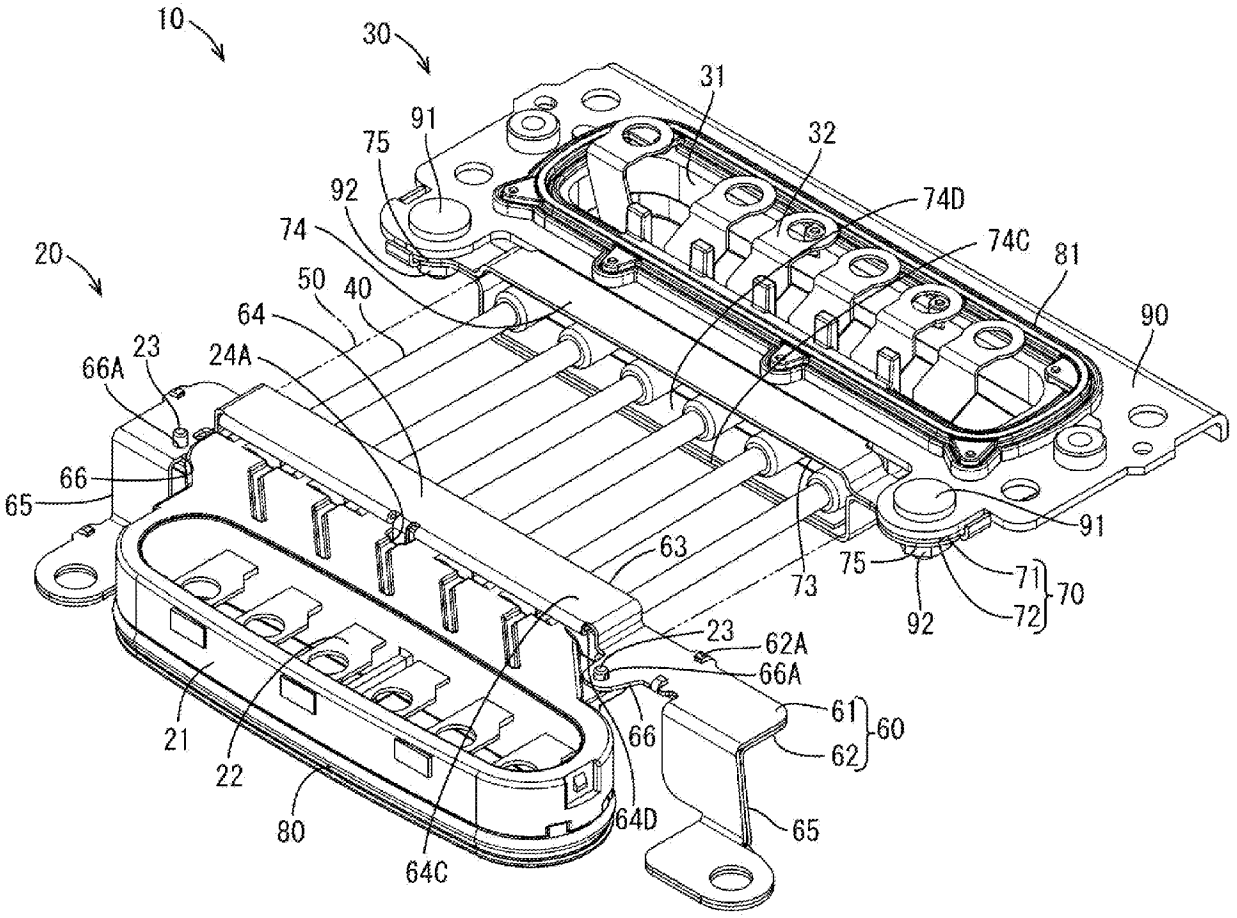
FIG. 3 is a perspective view showing a state where wires are arranged through a shield member of the wiring harness.
Figure 4:
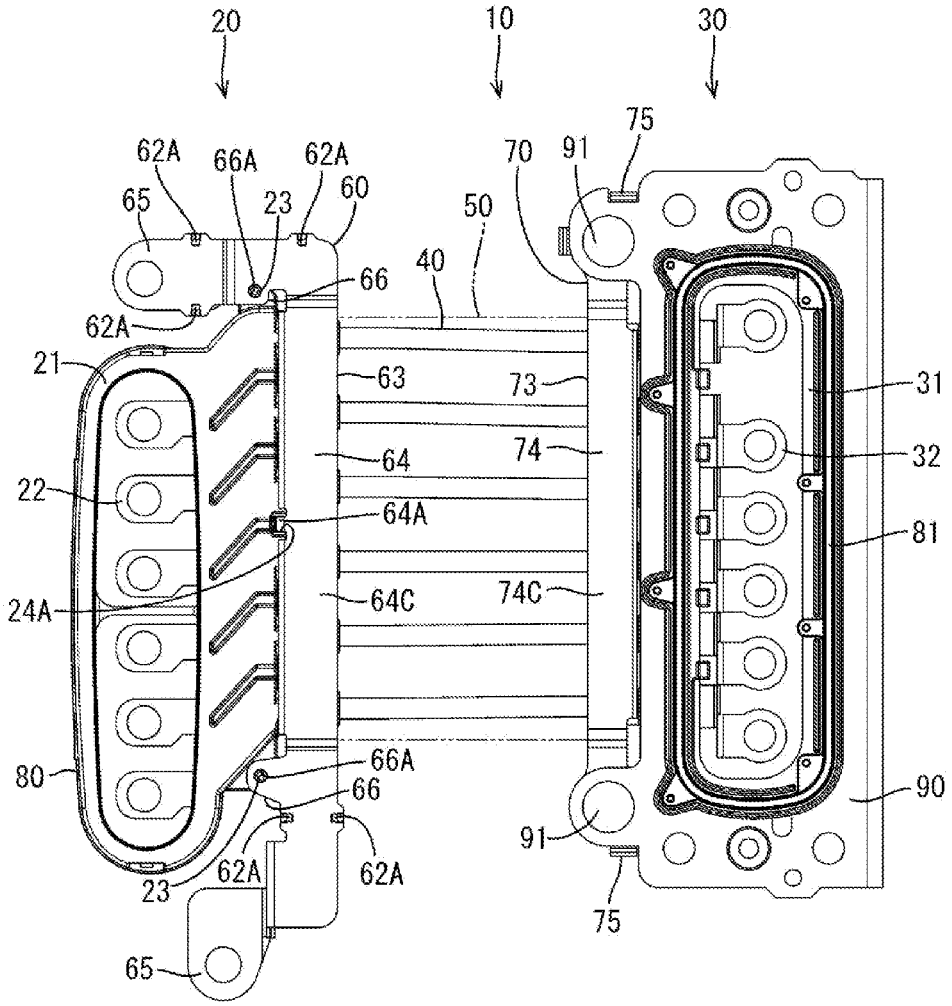
FIG. 4 is a front view showing the state where the wires are arranged through the shield member of the wiring harness.
Figure 5:
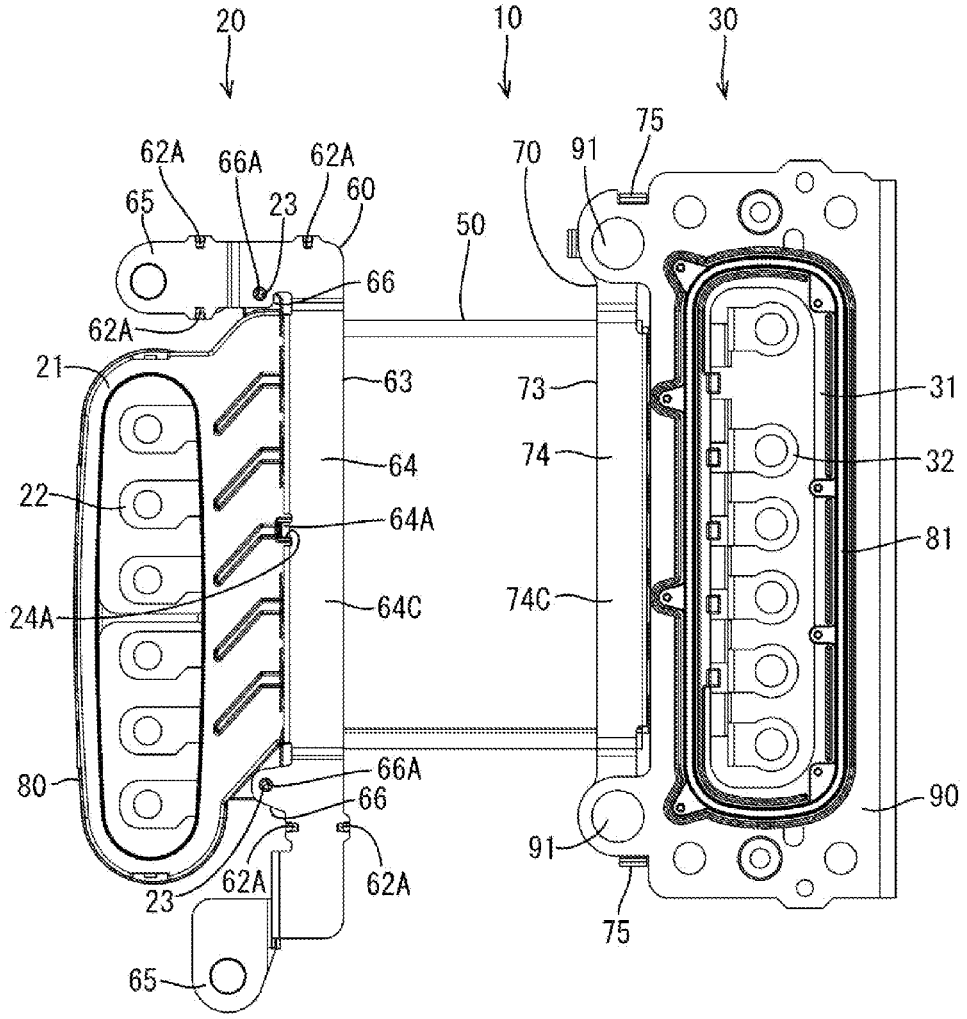
FIG. 5 is a front view of the wiring harness.
Figure 6:
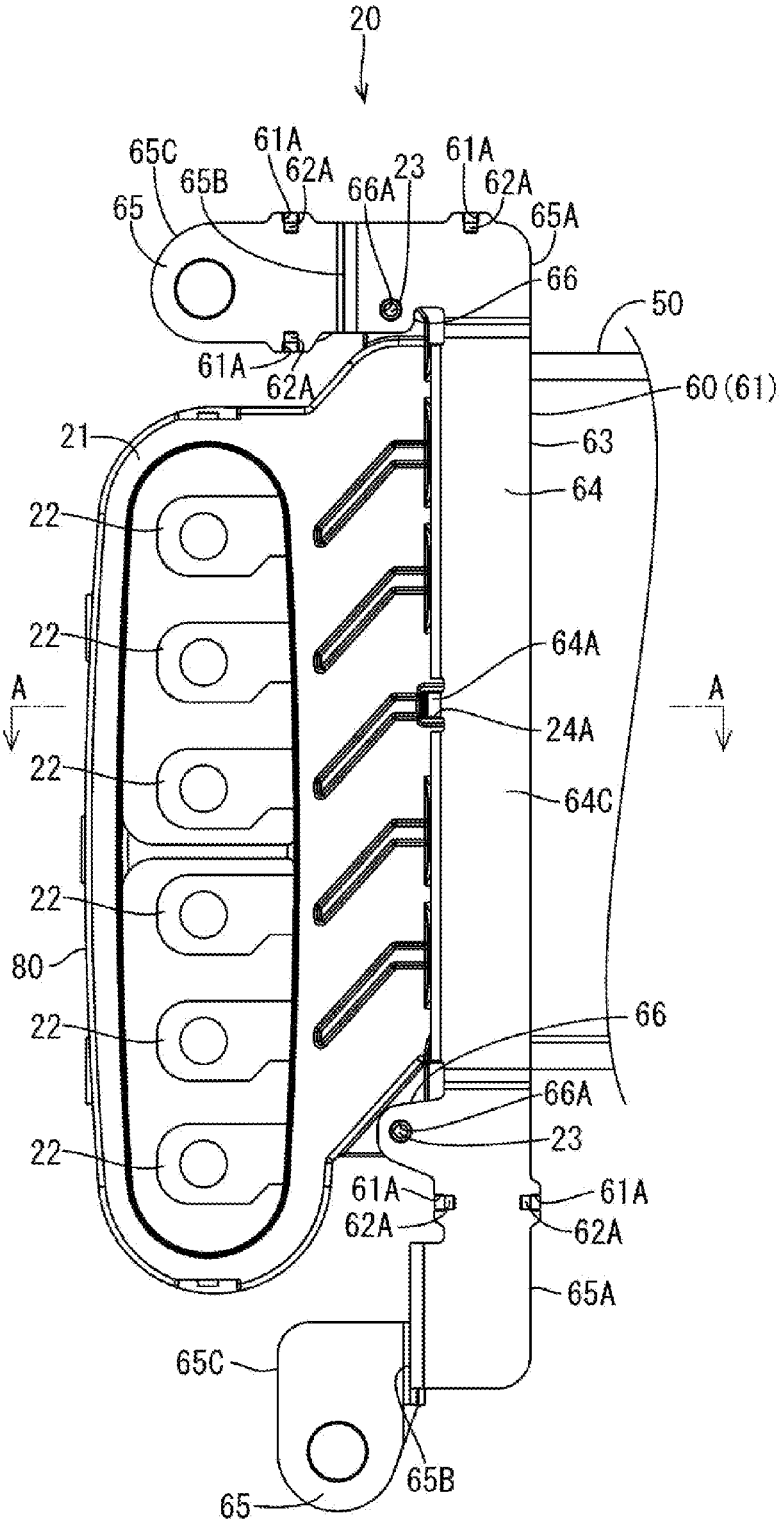
FIG. 6 is a view enlargedly showing a first shield connector in FIG. 5.

As shown in FIG. 3, wires 40 are arranged side by side in parallel between the first and second shield connectors 20, 30. The wire 40 includes a core formed by bundling a plurality of strands made of copper, copper alloy, aluminum or aluminum alloy and a coating made of insulating resin covers the core. The wire 40 has a large diameter corresponding to the use of a large current, but has such flexibility to be bendable substantially at 90°. Since the plurality of wires 40 are arranged side by side without being bundled, they can be bent collectively substantially at 90°.

Figure 1:
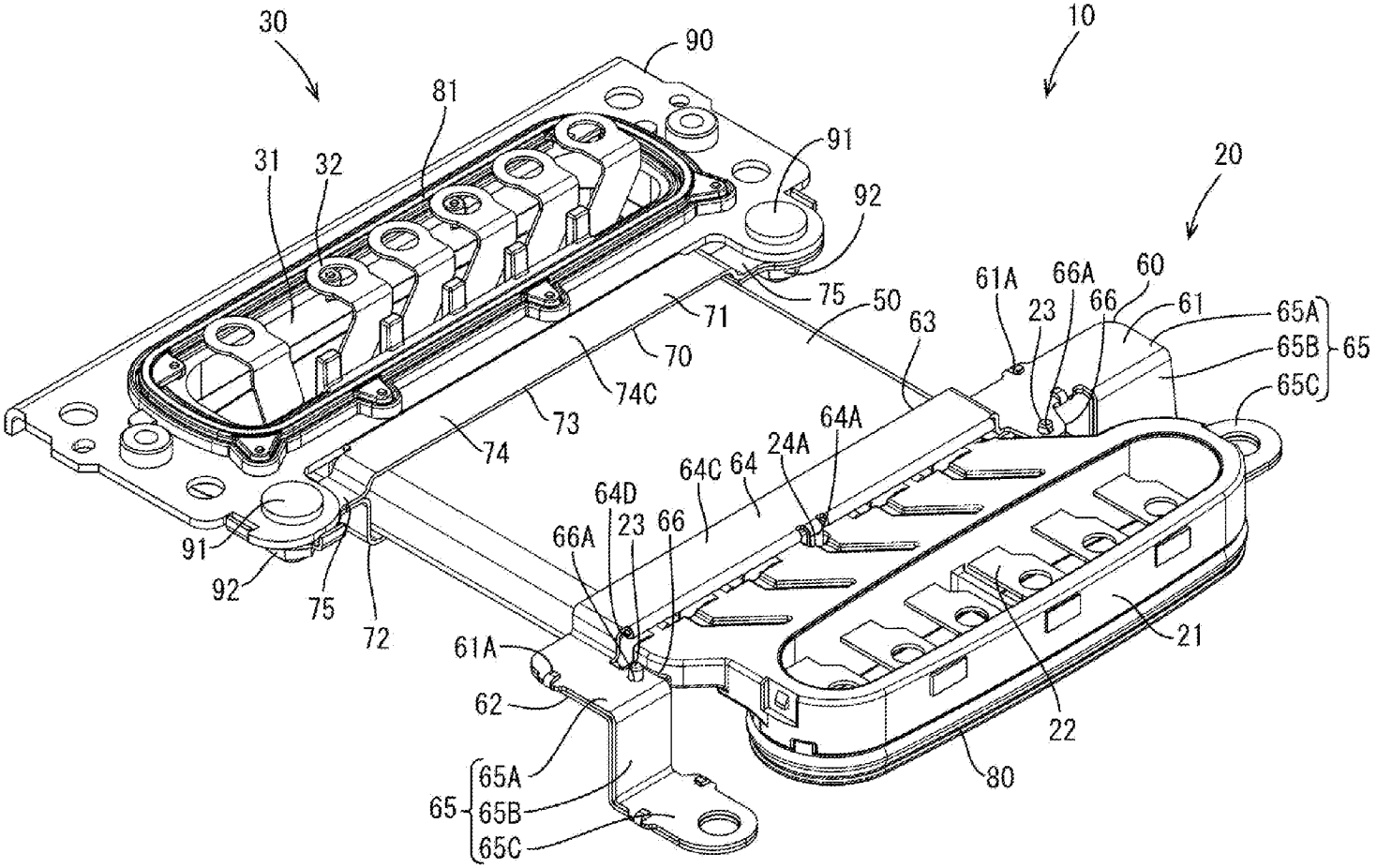
FIG. 1 is a perspective view of a wiring harness.
Figure 2:
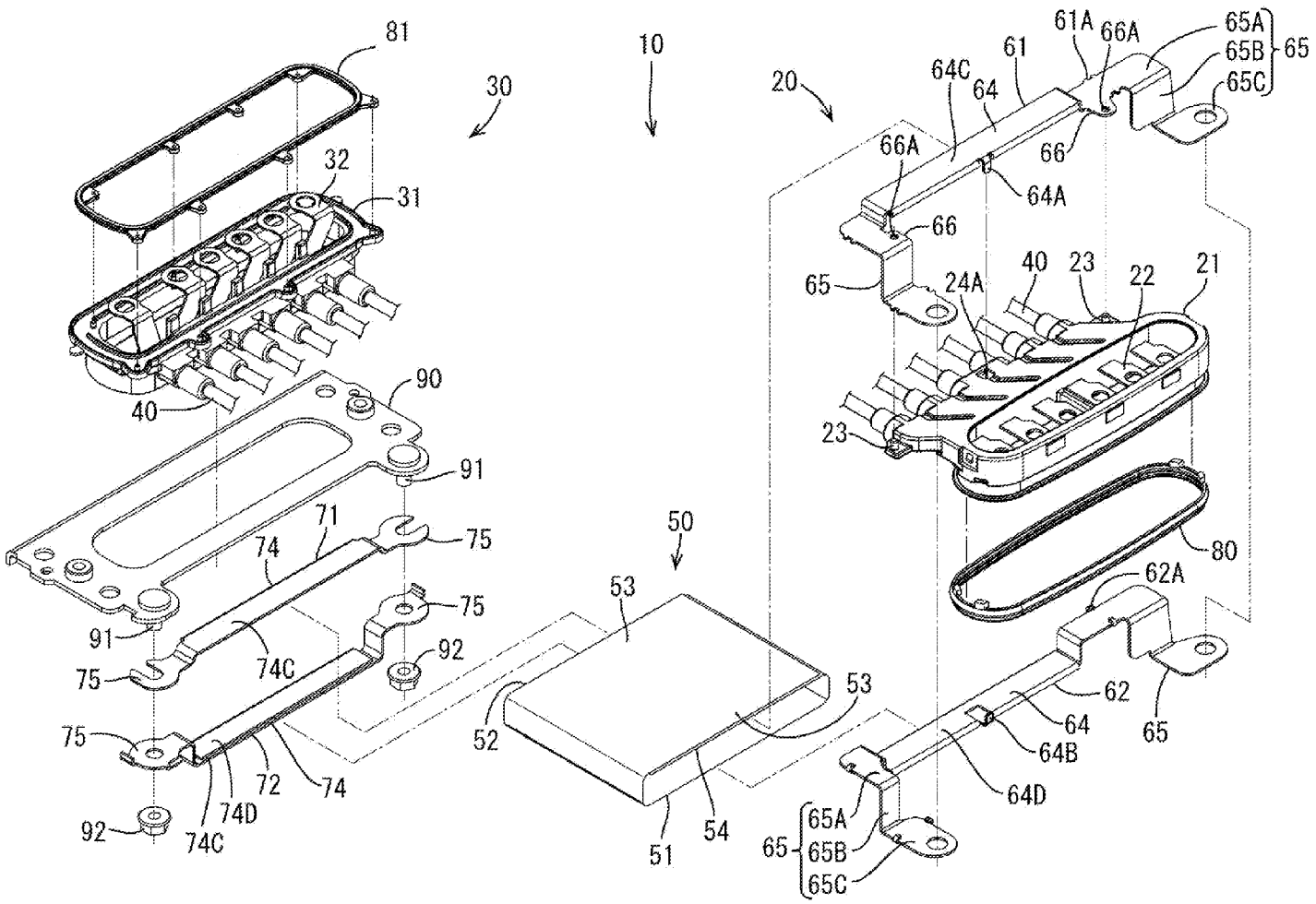
FIG. 2 is an exploded perspective view of the wiring harness.

As shown in FIG. 2, the second shield connector 30 includes a second housing 31 made of synthetic resin and second terminals 32 are molded integrally to the second housing 31. A metal plate 90 is mounted in the second shield connector 30 and the second shield connector 30 is fixed to the case of the inverter by bolt-fastening this metal plate 90 to the case of the inverter.

A second seal ring 81 is mounted on the second housing 31 and is sandwiched between the metal plate 90 and an outer surface of the case of the inverter to seal the interior of the case of the inverter and the interior of the second housing 31 as the metal plate 90 is bolt-fastened to the case of the inverter.

A second bracket 80 composed of a second upper bracket 71 and a second lower bracket 72 is mounted on the metal plate 90 by bolt fastening. As shown in FIG. 3, the second bracket 70 includes a second tubular portion 73 that allows the wires 40 to be passed collectively therethrough, in a state where the second upper and lower brackets 72, 72 are assembled with each other. The second bracket 70 is formed by punching an electrically conductive metal plate and bending punched-out metal pieces.

Upper and lower second shield member connecting portions 74 are formed on facing side parts constituting longer sides of the second tubular portion 73 and connect to another end part 52 of a shield member 50 to be described later. The second shield member connecting portions 74 are plate-like and face each other when the second upper and lower brackets 72, 72 are assembled with each other. On the other hand, pairs of plate connecting portions 75 bulge out laterally on a pair of facing side parts constituting shorter sides of the second tubular portion 73 and are fastened together to the metal plate 90. Specifically, through holes are formed on overlapping parts formed by overlapping a pair of plate connecting portions 75, and the plate connecting portions 75 are fastened together to the metal plate 90 by inserting bolts 91 of the metal plate 90 into the through holes and fastening nuts 92.

As shown in FIG. 2, the first shield connector 20 includes a first housing 21 made of synthetic resin and a first terminal 22 integrally molded to the first housing 21. The first housing 21 fits into a mounting hole (not shown) that penetrates through the case of the motor. A first seal ring 80 is mounted on the outer peripheral surface of the first housing 21. When the first housing 21 is fit into the mounting hole of the case of the motor, the first seal ring 80 is sandwiched between the outer peripheral surface of the first housing 21 and the inner peripheral surface of the mounting hole to seal the interior of the case of the motor and the interior of the first housing 21.

A first bracket 60 composed of a first upper bracket 61 and a first lower bracket 62 is mounted on the first housing 21 by bolt fastening. Similarly to the second bracket 70, the first bracket 60 includes a first tubular portion 63 that allows the wires 40 to be passed collectively therethrough when the first upper and lower brackets 62, 62 are assembled with each other. Further, the first bracket 60 is formed by punching an electrically conductive metal plate and bending punched-out metal pieces.

Upper and lower first shield member connecting portions 64 are formed on a pair of facing side parts constituting longer sides of the first tubular portion 63 and are connected to one end part 51 of the shield member 50 to be described later. The first shield member connecting portions 64 are plate-like and face each other when the first upper and lower brackets 61, 62 are assembled with each other.

Pairs of case connecting portions 65 bulge out laterally on shorter facing side parts constituting the first tubular portion 63 and are bolt-fastened to the case constituting the outer surface of the motor. Further, the case connecting portion 65 is composed of a horizontal portion 65A horizontally extending from the shorter side of the first tubular portion 63, a vertical portion 65B vertically extending from a side edge of the horizontal portion 65A and a fastening portion 65C horizontally extending again from the tip of the vertical portion 65B. The horizontal portion 65A and the fastening portion 65C project in opposite directions with respect to the vertical portion 65B. Further, the horizontal portion 65A and the fastening portion 65C are parallel to each other and also parallel to the pair of first shield member connecting portions 64.

An overlapping part formed by overlapping the case connecting portion 65 of the first upper bracket 61 and the case connecting portion 65 of the first lower bracket 62 includes a plurality of holding projections 62A formed on the first lower bracket 62 and a plurality of holding portions 61A formed on the first upper bracket 61. The holding projections 62A and the holding portions 61A are distributed on the horizontal portions 65A and the fastening portions 65C. The holding projections 62A and the holding portions 61A are formed on both peripheral edges extending in a draw-out direction of the wires 40 and those extending in a direction perpendicular to the draw-out direction out of peripheral edges of the case connecting portions 65. Thus, the case connecting portions 65 are united and held in an overlapping state by bending and hooking the holding projections 62A to fit them into the holding portions 61A.

Further, stoppers 66 bulge out toward the first housing 21 on peripheral edges of the horizontal portions 65A of the case connecting portions 65 of the first upper bracket 61. Holes 66A penetrate through the stoppers 66. On the other hand, retaining projections 23 to be inserted into the holes 66A of the stoppers 66 are formed on the outer peripheral surface of the first housing 21.

Figure 7:
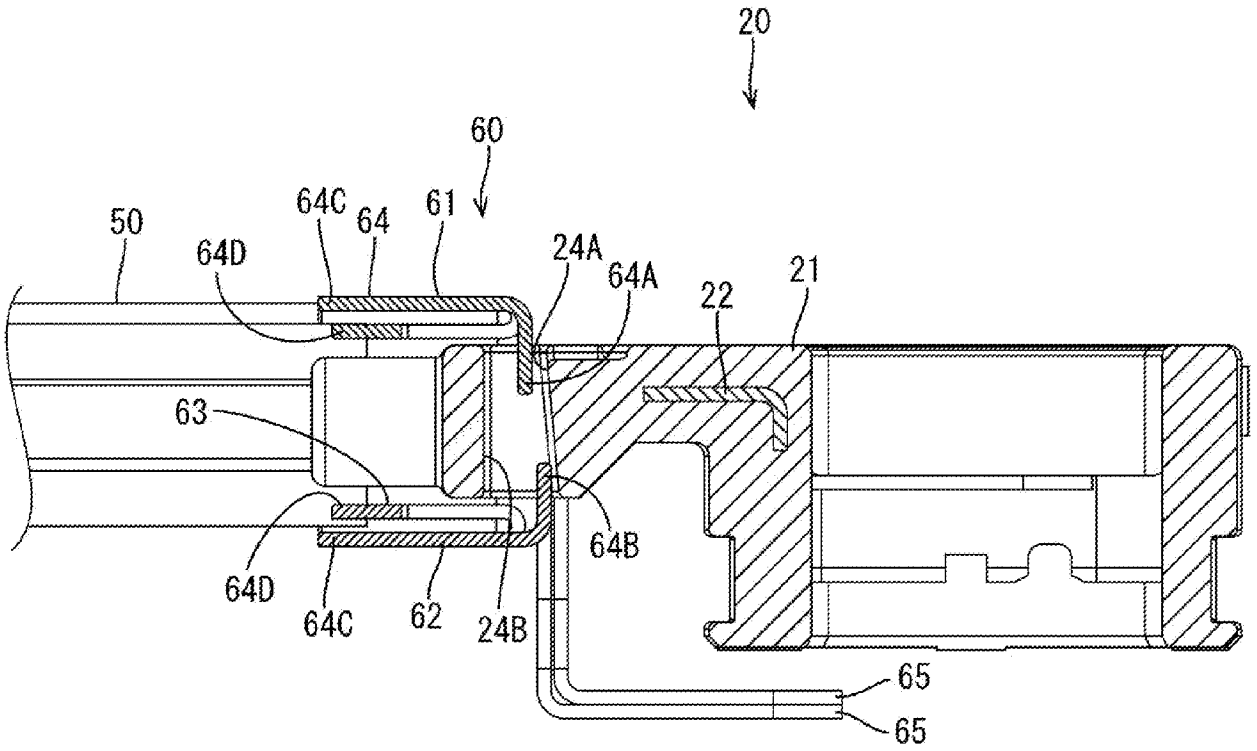
FIG. 7 is a section along A-A of FIG. 6.
Figure 8:
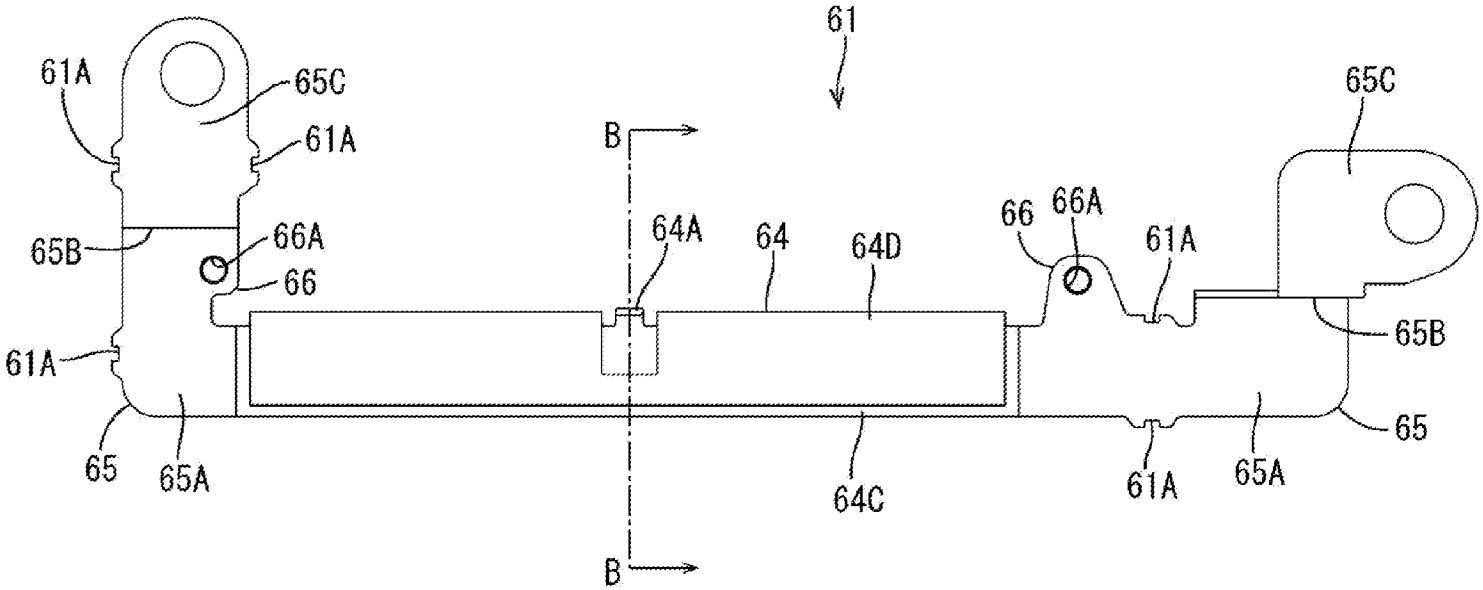
FIG. 8 is a front view of a first upper bracket.

As shown in FIG. 2, an upper mounting projection 64A is formed on a side edge of the first shield member connecting portion 64 of the first upper bracket 61. This upper mounting projection 64A projects down in the center of the longer side part of the first shield member connecting portion 64. On the other hand, an upwardly open upper mounting hole 24A is formed on the upper surface of the first housing 21 and can receive the upper mounting projection 64A from above, as shown in FIG. 7.

Similarly, a lower mounting projection 64B is formed on a side edge of the first shield member connecting portion 64 of the first lower bracket 62. The lower mounting projection 64B projects up in the center of the longer side part of the first shield member connecting portion 64. On the other hand, a downwardly open lower mounting hole 24B is formed on the lower surface of the first housing 21 and can receive the lower mounting projection 64B from below, as shown in FIG. 7. Note that the upper and lower mounting holes 24A, 24B communicate with each other and are formed so that an opening diameter gradually increases from the upper mounting hole 24A toward the lower mounting hole 24B. Specifically, the rear inner surfaces of the both mounting holes 24A, 24B are inclined obliquely from one end (shown right end in FIG. 7) on the opening edge of the upper mounting hole 24A toward one end (shown right end in FIG. 7) on the opening edge of the lower mounting hole 24B.

The first bracket 60 is movable a predetermined distance in a vertical direction when the upper mounting projection 64A is inserted in the upper mounting hole 24A and the lower mounting projection 64*b* is inserted in the lower mounting hole 24B. Further, the first bracket 60 is movable a predetermined distance in a horizontal direction when a pair of retaining projections 23 are inserted respectively in the holes 66A of a pair of stoppers 66. Thus, when the first bracket 60 is fixed to the case of the motor, the first shield connector 20 is not detached from the first bracket 60, but is allowed to move the predetermined distance in the vertical and horizontal directions.

The shield member 50 is made of an electrically conductive metal cloth and a woven fabric formed by weaving metal threads unlike a so-called braided wire. Specifically, a plurality of metal threads are crossed in X shape in the braided wire, whereas a plurality of metal threads are composed of yarns and wefts and crossed in + shape in the metal cloth. Thus, the metal threads are easily frayed in the braided wire, whereas the metal threads are not frayed in the metal cloth. Such a metal cloth is a fabric having a network structure in which metal threads mainly containing, for example, copper are woven while intersecting in longitudinal and lateral directions. Further, the metal cloth may be so structured that a flexible film made of a resin material is bonded to a fabric of metal threads.

Figure 9:
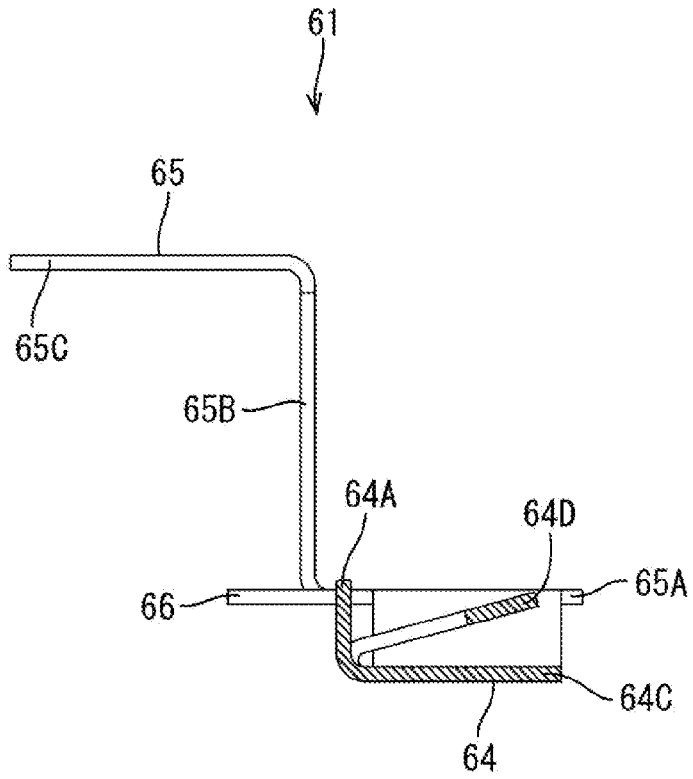
FIG. 9 is a section along B-B of FIG. 8.
Figure 10:
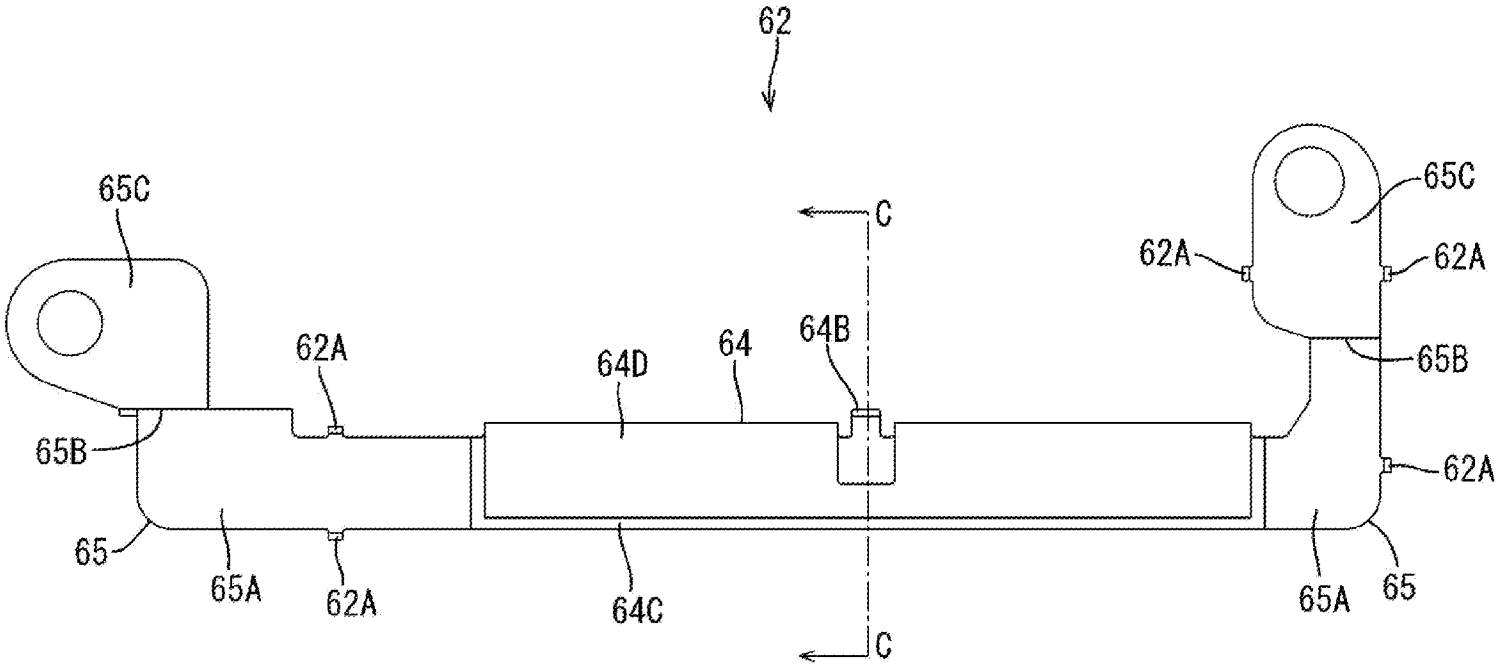
FIG. 10 is a front view of a first lower bracket.
Figure 11:
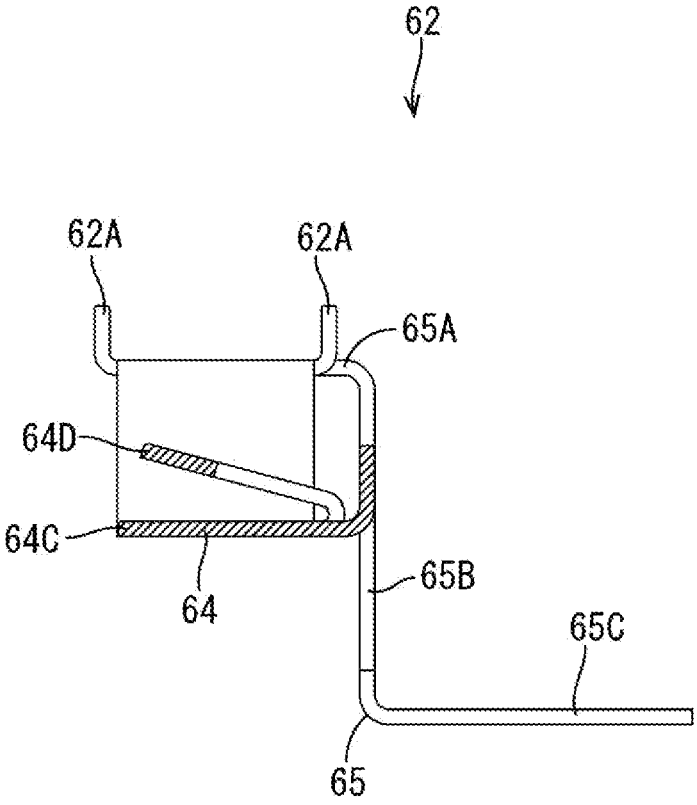
FIG. 11 is a section along C-C of FIG. 10.

The first shield member connecting portion 64 of the first upper bracket 61 includes a first base plate 64C and a first crimping piece 64D coupled at an acute angle to this first base plate 64C as shown in FIG. 9. The upper mounting projection 64A is formed by cutting and bending a part of the first crimping piece 64D. Further, the first shield member connecting portion 64 of the first lower bracket 62 includes a first base 64C and a first crimping piece 64D coupled at an acute angle to the first base plate 64C as shown in FIG. 11. The upper mounting projection 64B is formed by cutting and bending a part of the first crimping piece 64D. The case connecting portions 65 of the first bracket 60 are provided at opposite sides of the first base plates 64C.

Note that, as shown in FIG. 2, the second shield member connecting portion 74 includes a second base plate 74C and a second crimping piece 74D coupled at an acute angle to the second base plate 74C. The case connecting portions 75 of the second bracket 70 are provided at opposite sides of the second base plates 74C.

When a peripheral edge part of the shield member 50 is inserted between the first base plates 64C and the first crimping pieces 64D and crimping is performed using a crimping machine (not shown), the first crimping pieces 64D are caulked and crimped to the peripheral edge of the shield member 50. Crimping is performed for the upper and lower shield member connecting portions 64 to mount the first upper bracket 61 on the first housing 21 from above and mount the first lower bracket 62 on the first housing 21 from below. At this time, each retaining projection 23 of the first housing 21 is inserted into the hole 66A of the corresponding stopper 66 of the first upper bracket 61, the upper mounting projection 64A of the first upper bracket 61 is inserted into the upper mounting hole 24A and the lower mounting projection 64B of the first lower bracket 62 is inserted into the lower mounting hole 24B. In this way, the upper and lower case connecting portions 65 are overlapped and the first upper and lower brackets 61, 62 are united by bending and hooking each holding projection 62A to the corresponding holding portion 61A to form the first bracket 60. Associated with this, the first tubular portion 63 is formed and the shield member 50 also is formed into a tubular shape.

Subsequently, the first housing 21 is fit into the mounting hole of the motor and each case connecting portion 65 is bolt-fastened to the case of the motor to fix the first bracket 60 to the case of the motor. In this way, the shield member 50 is connected to the case of the motor via the first bracket 60.

As described above, in this embodiment, the first shield member connecting portions 64 are arranged to face each other, the case connecting portions 65 are arranged in the overlapping state and the case connecting portions 65 in the overlapping state are bolt-fastened to the case, thereby fixing the first upper and lower brackets 61, 62 to the case. Further, by inserting the retaining projections 23 of the first housing 21 through the holes 66A of the stoppers 66 of the first upper bracket 61, the first upper and lower brackets 61, 62 can be held on the first housing 21. In this way, the first upper and lower brackets 61, 62 including the plate-like crimping piece 64D can be mounted on the first housing 21.

The holding projections 62A may be formed on the case connecting portions 65 of the first lower bracket 62 and the of the case connecting portions 65 may be held in the overlapping state by hooking these holding projections 62A to peripheral edges of the case connecting portions 65 of the first upper bracket 61. According to this configuration, the case connecting portions 65 can be held in the overlapping state by hooking the holding projections 62A formed on the case connecting portions 65 of the first lower bracket 62 to the peripheral edges of the case connecting portions 65 of the first upper bracket 61 after the first upper and lower brackets 61, 62 are brought closer to each other and the case connecting portions 65 are overlapped.

The stoppers 66 bulge out toward the first housing 21 from the peripheral edges of the case connecting portions 65. Thus, the holding projections 62A of the first housing 21 can be reduced in size since the stoppers 66 can be arranged close to the first housing 21.

One shield member connecting portion 64 may be formed with a mounting projection projecting toward the other shield member connecting portion 64 and the first housing 21 may be formed with a mounting hole into which the mounting projection is to be inserted. Thus, the first bracket 60 can be mounted more stably on the first housing 21 by inserting the mounting projection into the mounting hole besides by the stopper portions 66.

The mounting projections 64A, 64B may be formed on the shield member connecting portions 64 and mounting holes 24A, 24B into which mounting projections 64A, 64B are to be inserted may communicate with each other. Thus, the first upper and lower brackets 61, 62 can be mounted more stably on the first housing 21 by inserting the mounting projections 64A, 64B into the mounting holes 24A, 24B.

The invention is not limited to the above described and illustrated embodiment. For example, the following embodiments are also included in the scope of the invention.

Although the holding projections 62A and the holding portions 61A are used as means for holding the pairs of case connecting portions 65 in the overlapping state in the above embodiment, the pairs of case connecting portions may be held in the overlapping state by being bolt-fastened to each other according to the present invention.

Although the stoppers 66 are formed to bulge out toward the first housing 21 from the peripheral edges of the case connecting portions 65 in the above embodiment, they may be formed to bulge out toward a side opposite to the first housing 21 according to the present invention. Further, it is not necessary to provide the pair of left and right stopper portions 66 and only one stopper portion may be formed.

Although the mounting projections 64A, 64B are formed on the first shield member connecting portions 64 in the above embodiment, they may be formed on parts other than the first shield member connecting portions 64 according to the present invention. Further, it is not necessary to provide the pair of upper and lower mounting projections 64A, 64B and only one mounting projection may be formed.

LIST OF REFERENCE SIGNS

20 . . . first shield connector (shield connector)
21 . . . first housing (housing)
23 . . . retaining projection
24A . . . upper mounting hole
24B . . . lower mounting hole
40 . . . wire
50 . . . shield member
61 . . . first upper bracket
61A . . . holding portion
62 . . . first lower bracket
62A . . . holding projection
64 . . . first shield member connecting portion
64A . . . upper mounting projection
64B . . . lower mounting projection
65 . . . case connecting portion
66 . . . stopper portion
66A . . . hole

What is claimed is:

1. A shield connector to be mounted on a case of a device, comprising:

a housing made of resin;

a wire drawn out from the housing;

a shield member made of electrically conductive metal and to be mounted on the wire to shield the wire; and two brackets each including a plate-like shield member connecting portion to be crimped to a peripheral edge part of the shield member and a case connecting portion to be connected to the case of the device, wherein a pair of the case connecting portions are arranged at sides of a pair of the shield member connecting portions arranged to face each other and bolt-fastened to the case in an overlapping state, the case connecting portion is formed with a stopper including a hole, the housing is formed with retaining projections to be inserted through the holes, and the pair of brackets are held on the housing by inserting the retaining projections through the holes.

2. The shield connector of claim 1, wherein a holding projection is formed on either one of the case connecting portions and the pair of case connecting portions are held in the overlapping state by hooking the holding projection to a peripheral edge of the other case connecting portion.

3. The shield connector of claim 2, wherein the stoppers bulge out toward the housing from peripheral edges of the case connecting portions.

4. The shield connector of claim 1, wherein one shield member connecting portion is formed with a mounting projection projecting toward the other shield member connecting portion and the housing is formed with a mounting hole into which the mounting projection is to be inserted.

5. The shield connector of claim 4, wherein the mounting projection is formed on each of the pair of shield member connecting portions and a pair of the mounting holes into which the mounting projections are to be inserted communicate with each other.

* * * * *